US006227899B1

(12) United States Patent
Bogese, II

(10) Patent No.: US 6,227,899 B1
(45) Date of Patent: May 8, 2001

(54) MODULAR PLUG HAVING IMPROVED CROSSTALK CHARACTERISTICS

(75) Inventor: Stephen B. Bogese, II, Roanoke, VA (US)

(73) Assignee: Thomas & Betts Corporation, Memphis, TN (US)

( * ) Notice: Subject to any disclaimer, the term of this patent is extended or adjusted under 35 U.S.C. 154(b) by 0 days.

(21) Appl. No.: 09/224,497

(22) Filed: Dec. 31, 1998

(51) Int. Cl.[7] ..... H01R 4/24; H01R 4/26; H01R 11/20

(52) U.S. Cl. ..... 439/418; 439/941

(58) Field of Search ..... 439/344, 418, 439/676, 941, 910

(56) References Cited

U.S. PATENT DOCUMENTS 5,727,962 * 3/1998 Caveney et al. ..... 439/344
5,984,713 * 11/1999 Hsien ..... 439/418
6,007,368 * 12/1999 Lorenz et al. ..... 439/418

* cited by examiner

*Primary Examiner*—Brian Sircus
*Assistant Examiner*—Brian S. Webb
(74) *Attorney, Agent, or Firm*—Hoffman & Baron, LLP

(57) ABSTRACT

A modular telephone-style plug features a substantially three sided intermediate section which integrally connects the cable receiving end with the contact mating end of the plug. The intermediate section has an opening which spans virtually all of the fourth side of this section. The resultant three sided intermediate section provides for a reduced dielectric constant in the interior space in which the critical conductor transition from jacketed cable to contact termination occurs. This produces lower crosstalk and higher data propagation to allow this modular plug to be capable of a higher frequency for data transmission. The intermediate section features an expanded interior to lower crosstalk between twisted pairs of conductors over a wide range of data transmission rates. The intermediate section's expanded interior space permits greater freedom in the placement and relative positioning of any conductor pair to any other conductor pair. This interior space allows conductor pairs to be located a greater distance apart which reduces crosstalk substantially at higher frequencies. By utilizing the larger interior space, conductor pairs may also be placed angularly to each other so that conductor pairs are not co-planar, which further reduces crosstalk.

23 Claims, 13 Drawing Sheets

MODULAR PLUG HAVING IMPROVED CROSSTALK CHARACTERISTICS

BACKGROUND OF THE INVENTION

1. Field of the Invention

The present invention relates to electrical connectors and, more particularly, is directed toward a telephone-style modular plug that can operate at higher frequencies with lower crosstalk.

2. Description of Related Art

Data communication systems being developed are constantly requiring higher and higher transmission rates. As the rates have increased to the 100 Megahertz (MHz) range, the problem of near end crosstalk (NEXT) has become particularly vexing. Crosstalk refers to the signals induced in an adjacent conductor due to magnetic (inductive) and electric field (capacitive) coupling between the conductors. The crosstalk of interest to this invention occurs in telephone-style modular plugs (near end crosstalk or "NEXT"). The crosstalk in cables and modular jacks are related fields but are not specifically addressed by this invention.

Advances in cable design and improved control of manufacturing processes have improved the electrical performance of network data cables from −32 dB NEXT to better than −42 dB NEXT at a transmission frequency of 100 MHz. This is a dramatic improvement in isolating the coupling of a signal being transmitted through cables, especially those carrying eight conductors twisted together in pairs as used in the telecommunications industry. As a result of these advances in cable electrical performance, the performance of prior art modular plugs has fallen farther behind, so that the amount of crosstalk within a modular plug has become the most significant limiting factor in a system of networking cables, female modular jacks or Alto outlets, and male modular plugs. A large part of the problem arises when the conductors leave the protective confines of the cable jacket, even though crosstalk is minimized by the conductors remaining twisted together in pairs. In order to terminate the conductors in a telephone-style modular plug, however, they must be untwisted and mounted in the plug's dielectric housing in a substantially parallel arrangement, a condition wherein the conductors are most susceptible to NEXT.

NEXT is the electrical field generated by a signal which is transmitted into a first connection, and this electrical field has lines of force which pass around and into a second connection, causing an electrical signal to flow in the second connection. This induced electrical signal flow alters and acts upon any original transmitted signal sent through the second connection, with the outcome that any receiver of the second connection signal sees an altered, distorted signal. This is the source of signals that cannot be correctly understood and therefore requires that the original second transmitted signal be transmitted again, using up valuable data bandwidth and degrading the performance of a connection system. As crosstalk becomes increasingly larger, it can have the same signal strength as the original transmitted signal, rendering the entire connection useless because it is impossible to separate the induced signal (crosstalk) from the original signal. This is commonly referred to as S/N, or signal to noise ratio. If the noise (crosstalk) is as strong as the signal, then it is impossible to separate the original signal from the induced signal (noise). The reduction of crosstalk is extremely important to enable connection systems to transmit signals as error free as possible, and to increase the data frequency that a connection system can deliver with more signal than noise.

A number of years ago, a standards committee comprised of representatives of various companies and organizations in the electronics, computer, and telecommunications industries began the development of a voluntary standard called EIA/TIA 568. The objective of this standard was to provide for interchangeability between various manufacturers' components and to set forth a minimum set of electrical requirements needed to deliver a usable signal at frequencies up to 100 MHz independently of which manufacturer's products might be used in a networking connection system. This standard was completed only in the last few years and sets out mechanical and dimensional requirements for modular female jacks/outlets, and for modular male plugs to assure mating compatibility. This so-called 568 standard also defines a set of minimum electrical requirements for cables, for modular male plugs, and for modular female jacks/outlets at various frequencies from 0.772 MHz to 100 MHz for products classified into categories. For example, the electrical requirements for category 3 components is less stringent than the electrical requirements for category 5 Ad components. This standard also specifies the conductor wiring arrangements within the male plugs, distance limitations for cable and for cable assemblies terminated with modular plugs.

Referring now to the electrical requirements of EIA/TIA 568, it sets out the minimum NEXT for any one conductor pair to any other conductor pair within the cable, as well as within the male plug as terminated onto a section of cable. Inasmuch as modular plugs are relatively small in size, it is inevitable that the close proximity of the contacts and terminated ends of the conductors induce crosstalk between different signal pairs. The most crosstalk allowed for a category 5 modular plug between worst case pairs is −40 dB at 100 MHz. As category 5 cables generally have four conductor pairs, the worst case is those two conductor pairs that have the most crosstalk to each other and more crosstalk than any other two conductor pairs. Because of the wiring arrangement specified by EIA/TIA 568, the worst case pairs are always from pair 1, corresponding to contact positions in the plug of 4 and 5, measured to pair 2, corresponding to contact positions in the plug of 3 and 6 (see the wiring arrangements of FIGS. 1 and 2). This interleaved wiring arrangement creates a high level of crosstalk within the conductor wiring exposed in the plug.

Various approaches have been used to try and overcome these NEXT deficiencies in the design of the plug. As stated before, NEXT is a function of inductive and capacitive interactions between conductors. The general thrust of the industry is to address only the capacitive problems. Rohrbaugh et al., in U.S. Pat. No. 5,628,647, seek to reduce both the magnetic and capacitive coupling by utilizing the feature of staggering or offsetting conductor receiving channels, but the remainder of the most pertinent related art concentrate solely on the capacitive effects. For example, Kristiansen in his U.S. Pat. No. 5,284,447 forms an elongated aperture in the body of the contact terminals, thus reducing the capacitance between adjacent contact terminals by reducing the amount of their confronting surface areas. U.S. Pat. No. 5,593,314 to Lincoln teaches a structure which staggers the longitudinal location of the confronting bodies of the contact terminals to reduce their capacitance. U.S. Pat. No. 5,727,962, to Caveney et al. teaches the offset terminal end arrangement disclosed in Rohrbaugh et al., supra, and forces the cable into the modular plug as far as possible, so that the length of untwisted conductors will be as short as possible.

All of these prior art patents, specifically incorporated herein by reference, are successful in what they do, but they limit their concerns solely to the electrically conducting components, namely, to the arrangement of the conductors and the structure of the terminal contacts. The instant invention, in contrast, extends this inventive field to include the body of the modular plug.

Undesirable near end crosstalk between conductors is primarily a function of capacitance: the more the capacitance, the more the crosstalk. Thus, in order to reduce the NEXT, the capacitance between the conductors must be reduced. Capacitance is dependent on two factors: (1) it is inversely proportional to the center-to-center distance between the conductors; and (2) it is directly proportional to the dielectric constant of all of the matter surrounding the conductors. Consequently, increasing the distance between the primary conductors lowers the capacitance, and lowering the average dielectric constant in the vicinity of the conductors also lowers the capacitance.

The primary area of interest of the present invention is the reduction of the effective dielectric constant of the material surrounding the conductors, i.e., the average dielectric constant of all of the materials which are present.

While the recent prior art makes some improvement toward addressing the problem of NEXT within the plug as assembled onto the cable, it remains deficient in significantly improving NEXT in the critical transition area of the plug where the conductors leave the controlled structure of the jacketed cable and are exposed to each other in a confined environment prior to their point of termination by the contact blades.

OBJECTS AND SUMMARY OF THE INVENTION

A primary object of the present invention is to provide a modular plug with a reduced dielectric constant in the transition area of the conductors extending from the jacketed cable to the point of termination in the plug to overcome the crosstalk deficiencies of the prior art.

Another object of the present invention is to provide a larger interior volume within the modular plug for the transition of the conductors from the jacketed cable to the point of termination as a means of reducing crosstalk between the conductor pairs.

Yet another object of the present invention is to provide a means for bringing non-planar conductor pairs to their respective conductor channels with a minimum of planar alignment as yet a further means of reducing crosstalk between the conductor pairs.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
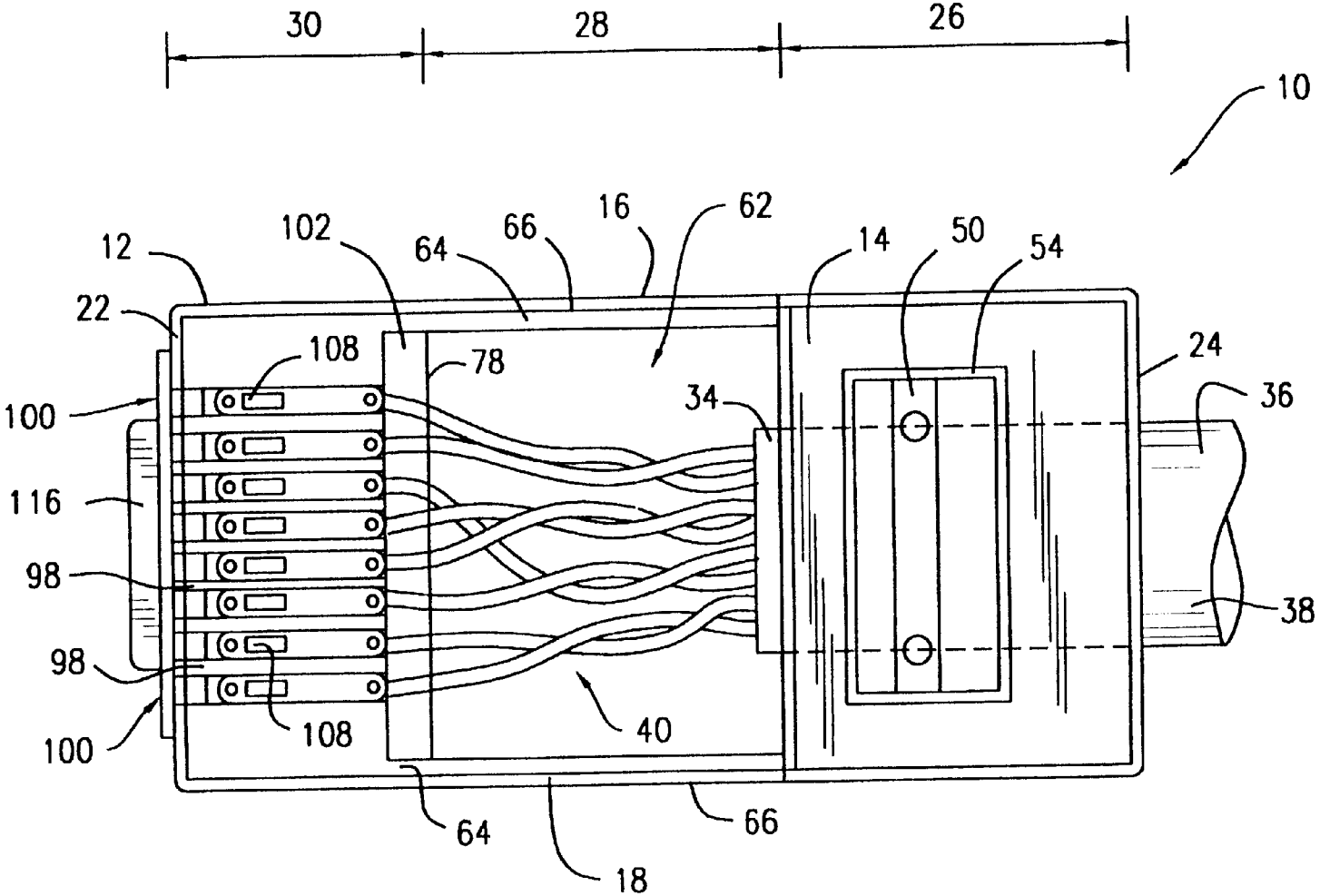
FIG. 1 is a top view which illustrates a telephone-style modular plug in a first preferred embodiment of the present invention.
Figure 2:
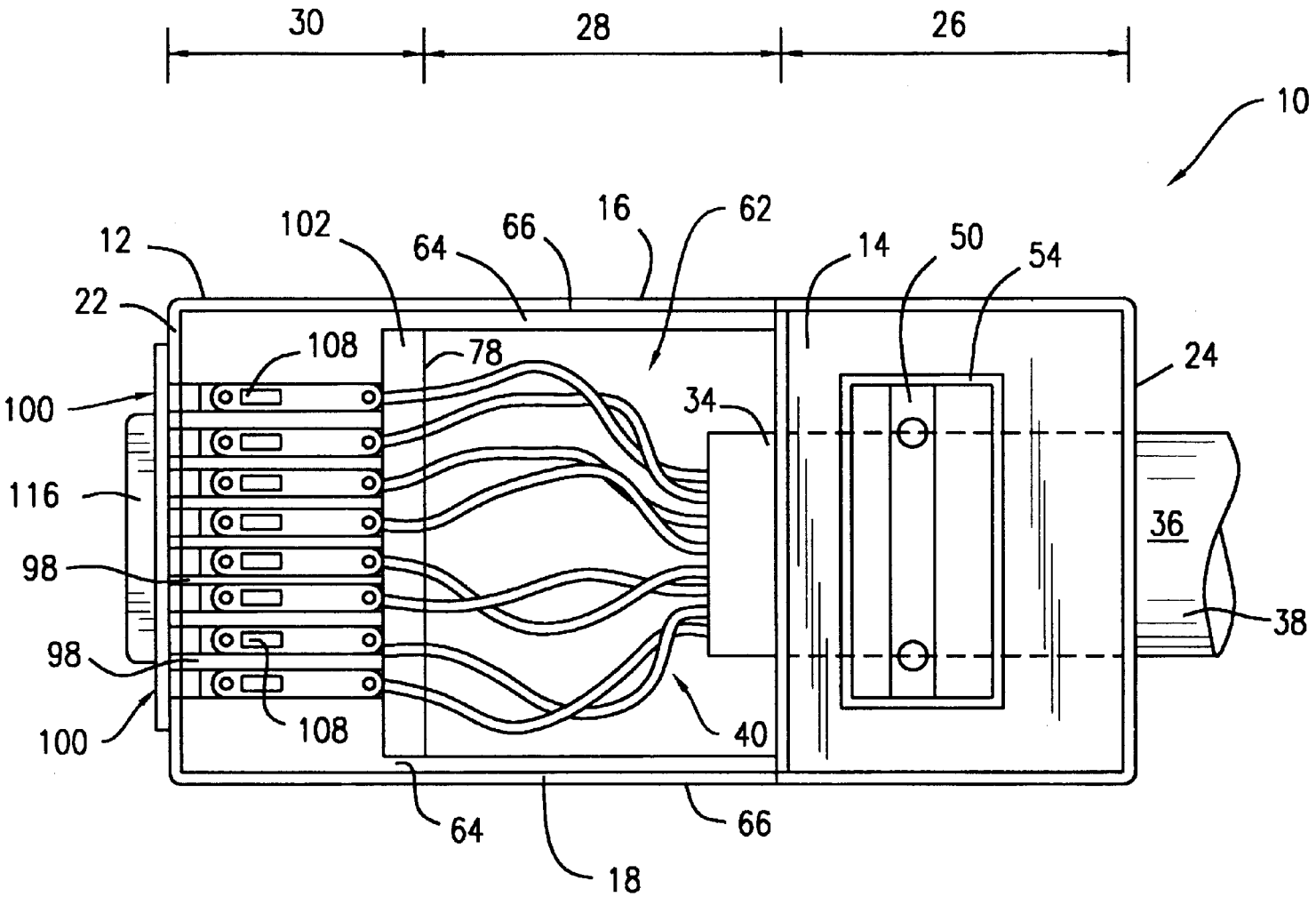
FIG. 2 is another top view of the modular plug of FIG. 1.

Referring to FIGS. 1–4, a telephone-style modular plug 10 comprises a housing 12 having a top 14, a pair of side walls 16 and 18, a bottom 20, a front 22, and a rear 24. Housing 12 can be visualized, for descriptive purposes, as being composed of three integral sections, a cable receiving section 26, an intermediate section 28, and a contact terminating section 30.

Cable receiving section 26 includes a cable receiving cavity 32 (FIG. 4) which receives the terminal end 34 of a cable 36.

Cable 36 typically comprises a jacket 38 enclosing, for example, four twisted pairs of insulated conductors 40 (FIGS. 1–2), each conductor comprising either a multiplicity of twisted strands or a solid wire. Cables can also be provided with a different number of conductors; for example, a two line telephone cable contains four conductors terminated in contact positions 3 through 6 of a standard modular plug. A cable housing ten conductors is also available, a construction which may be accommodated by modifications to the preferred embodiments, to be disclosed in greater detail below.

Figure 10:
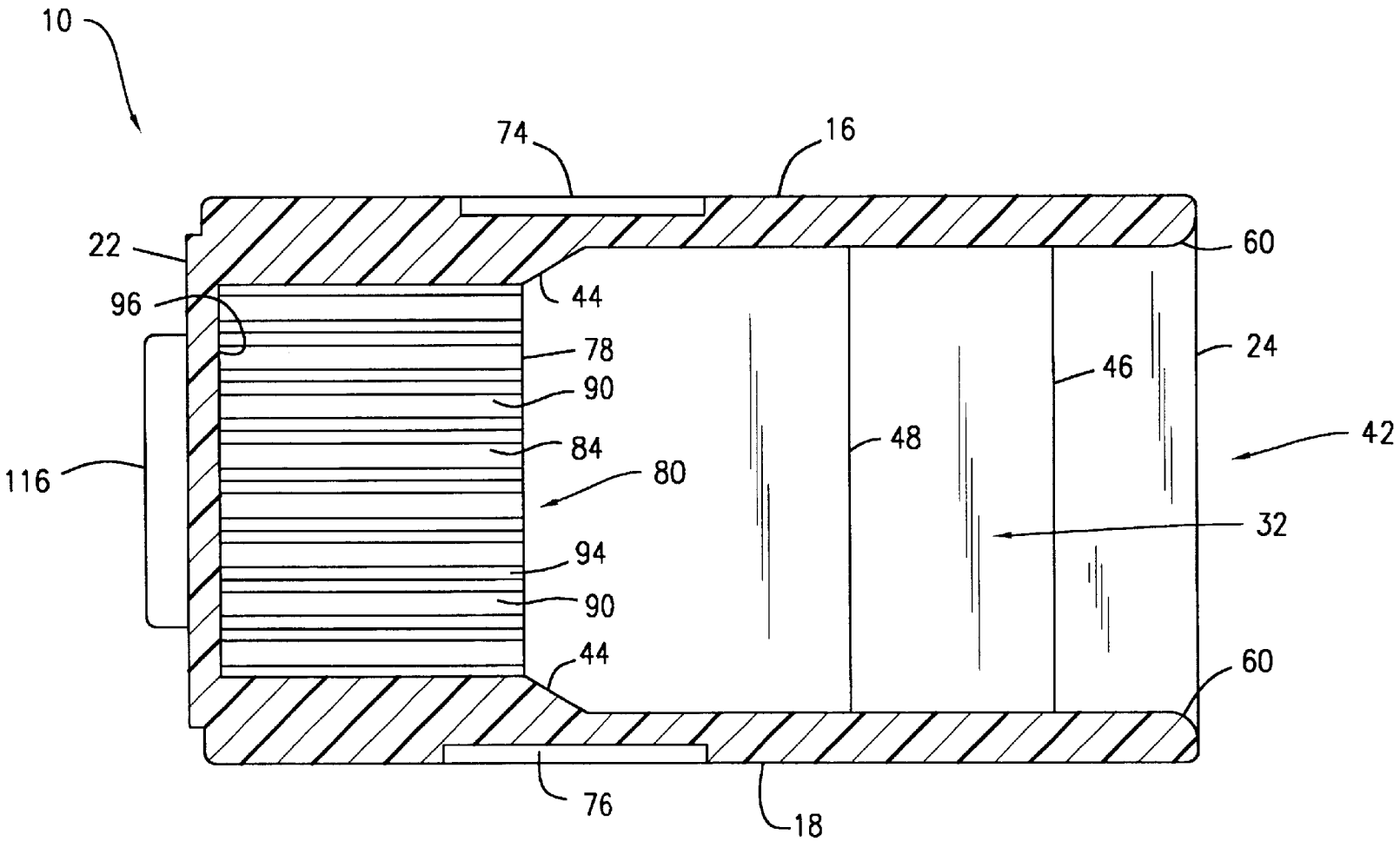
FIG. 10 is a sectional view of the modular plug of FIG. 1 taken along line D—D of FIG. 8.
Figure 11:
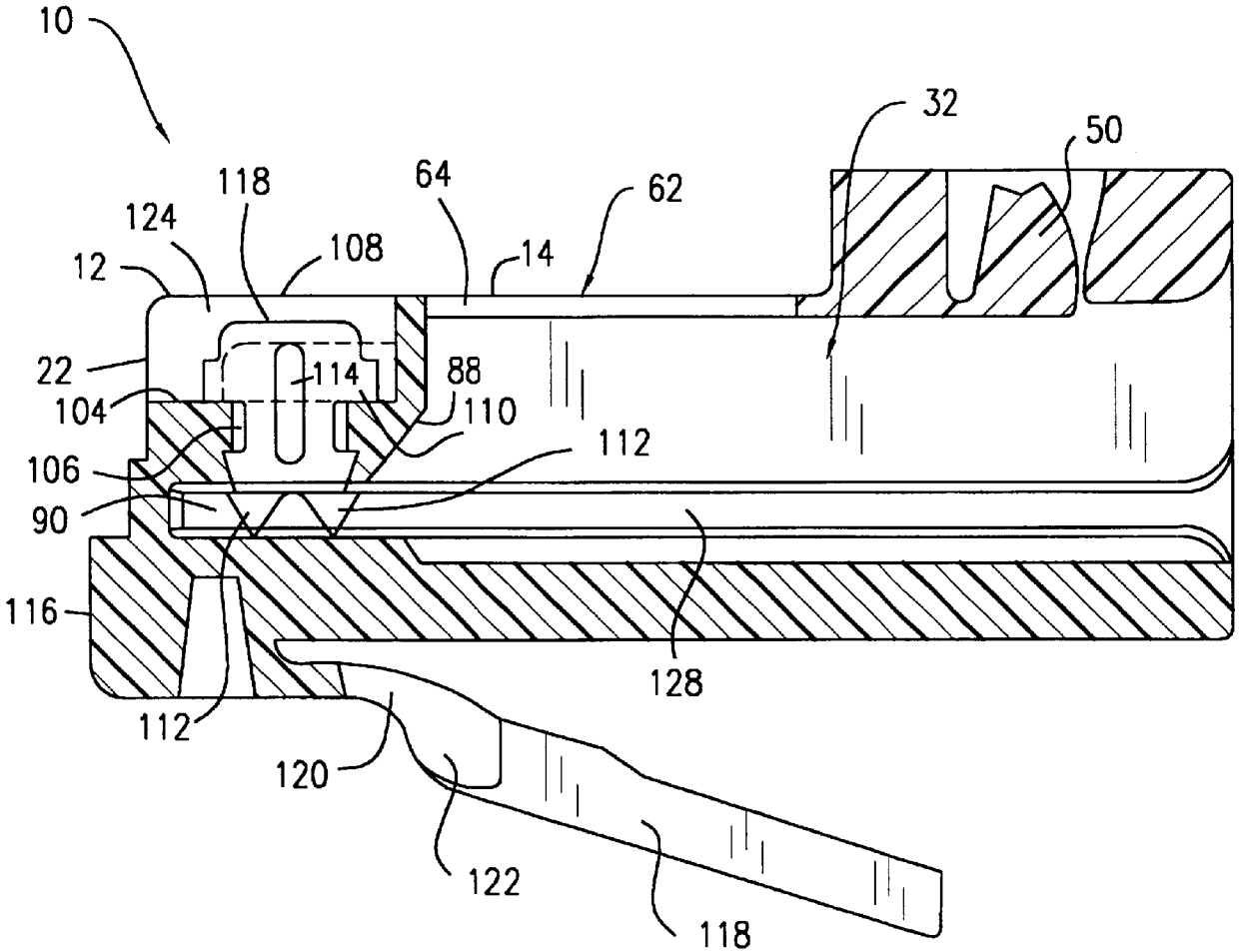
FIG. 11 is a longitudinal sectional view of a modified embodiment of the modular plug of FIG. 1.

Cable receiving cavity 32 (numbered in FIG. 4 and shown in outline in FIG. 3) extends from a cable receiving aperture 42 in rear 24 through cable receiving section 26 and through intermediate section 28 to a pair of opposed, flanking, vertical guide walls 44 which slope inwardly from sidewalls 16 and 18; see FIGS. 4, 5, 8, and 10. Within cable receiving section 26, the height of cable receiving cavity 32 steps down at shoulders 46 and 48 (FIG. 4) from its maximum height at cable receiving aperture 42 to its minimum height throughout intermediate section 28. The width of cable receiving cavity 32 is essentially the width of housing 12 and is bounded by side walls 16 and 18 (FIG. 10). A strain relief tab 50 pivots on a living hinge 52 within a transversely elongated aperture 54 in top 14 to pinch cable 36 to provide strain relief therefor, as is conventional in the art; see FIG. 13 of Caveney et al., supra, for example. Strain relief tab 50 includes a shoulder 56 which latches with corner 58 bordering aperture 54, when tab 50 is depressed downwardly into operative position. Rounded corners 60 (FIGS. 4–5 and 10) facilitate the insertion of cable 36 into cable receiving aperture 42.

Prior to exiting the terminal end 34 of cable 36, conductors 40 are protected by jacket 38 from outside electromagnetic influences. Near end crosstalk (NEXT) effects inside cable 36 are minimized by the conductors 40 being twisted together in pairs. But once conductors 40 leave terminal end 34 of cable 36 in intermediate section 28 (e.g., FIGS. 1–2), they must be untwisted to properly enter contact terminating section 30, as will be described in greater detail hereinafter. Within intermediate section 28, therefore, conductors 40 are particularly susceptible to NEXT.

The present invention acts to reduce NEXT in intermediate section 28 in various ways, which will now be discussed in turn.

First, and in accordance with the present invention, an opening 62 is formed in top 14 throughout intermediate section 28. Opening 62 has significant electrical effects on the signals traveling through the conductors 40 in intermediate section 28, because of its influence on the composite dielectric constant surrounding conductors 40. Modular plugs are typically made of polycarbonate. Polycarbonate is the preferred material, because of its unique combination of strength, resiliency, chemical inertness, and transparency. Polycarbonate, however, has one serious shortcoming in its properties, that of the dielectric constant. For high speed data transmission, the dielectric constant plays a critical role in the propagation rate of signals. The lower the dielectric constant, the better the electrical properties. Air has a good dielectric constant, while polycarbonate has a relatively poor dielectric constant. Since the present invention provides an opening 62 in intermediate section 28, the volume of the material of which modular plug 10 is made, namely, polycarbonate, is reduced, thus lowering the dielectric constant in the critical conductor transition area 28 between terminal end 34 of cable 36 and contact terminating section 30. This is significant because conductors 40 in this transition area are exposed outside of jacket 38 and therefore are more affected by the electrical properties of the material around those conductors. Because of opening 62, the average dielectric constant of the combination of the surrounding air and polycarbonate is noticeably lower than prior modular plug dielectric constants. Transmission rates are correspondingly improved, therefore.

Second, and in accordance with the present invention, opening 62 expands the volume of cable receiving cavity 32 in intermediate section 28. As a consequence, individual conductors 40 have more room to separate from each other, and each twisted pair has more room to separate from other twisted pairs. Since capacitance is inversely proportional to separation distance, separating conductors 40 reduces capacitance and thereby reduces NEXT.

Third, and in accordance with the present invention, each pair of conductors is left twisted for as long as possible before entering contact terminating section 30. Thus, the interactions between conductors is further minimized. See, for example, the conductors in FIGS. 1 and 2, to be discussed in greater detail below. In addition, a fourth way to reduce NEXT in intermediate section 28 will be discussed below.

Figure 8:
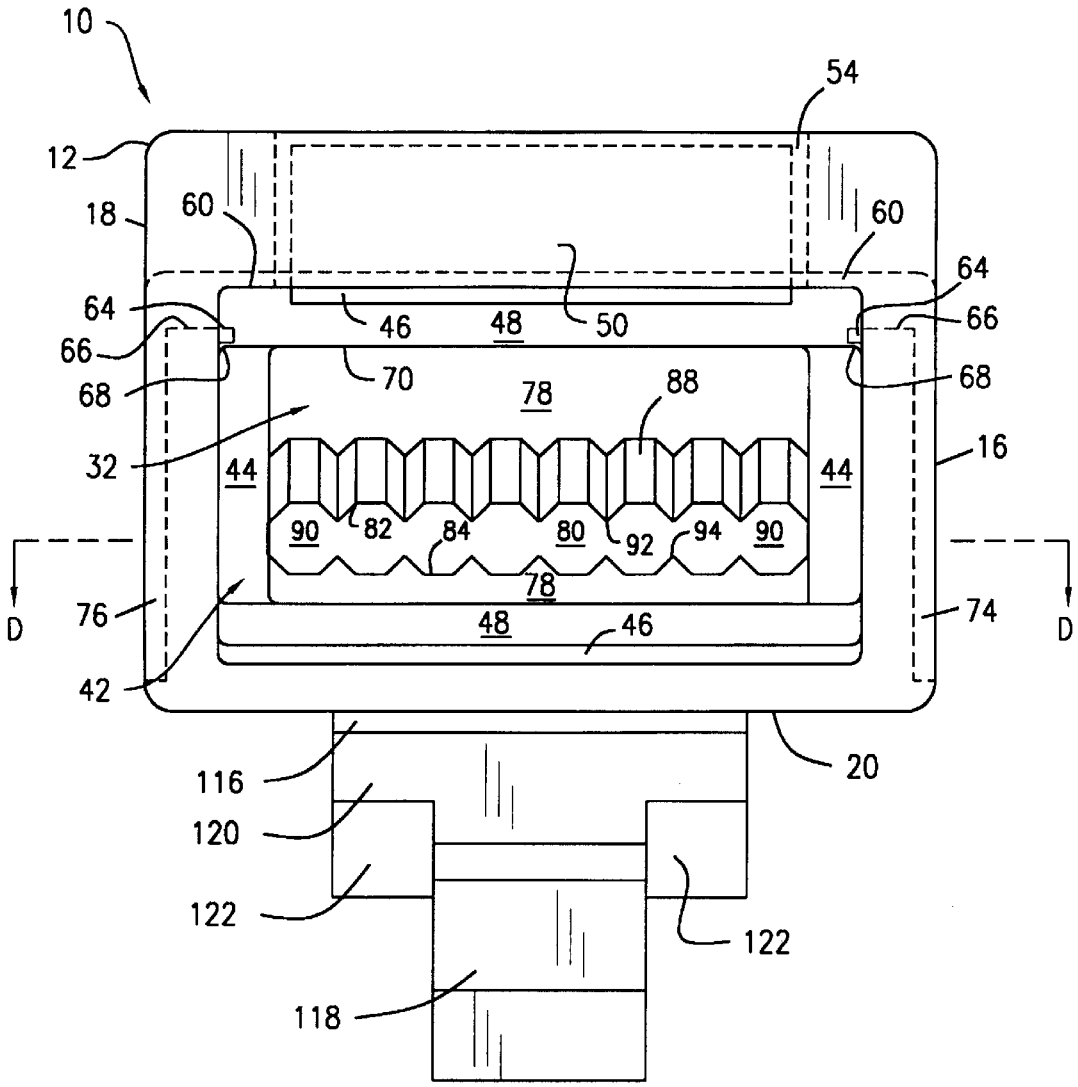
FIG. 8 is a rear view of the modular plug of FIG. 1.
Figure 9:
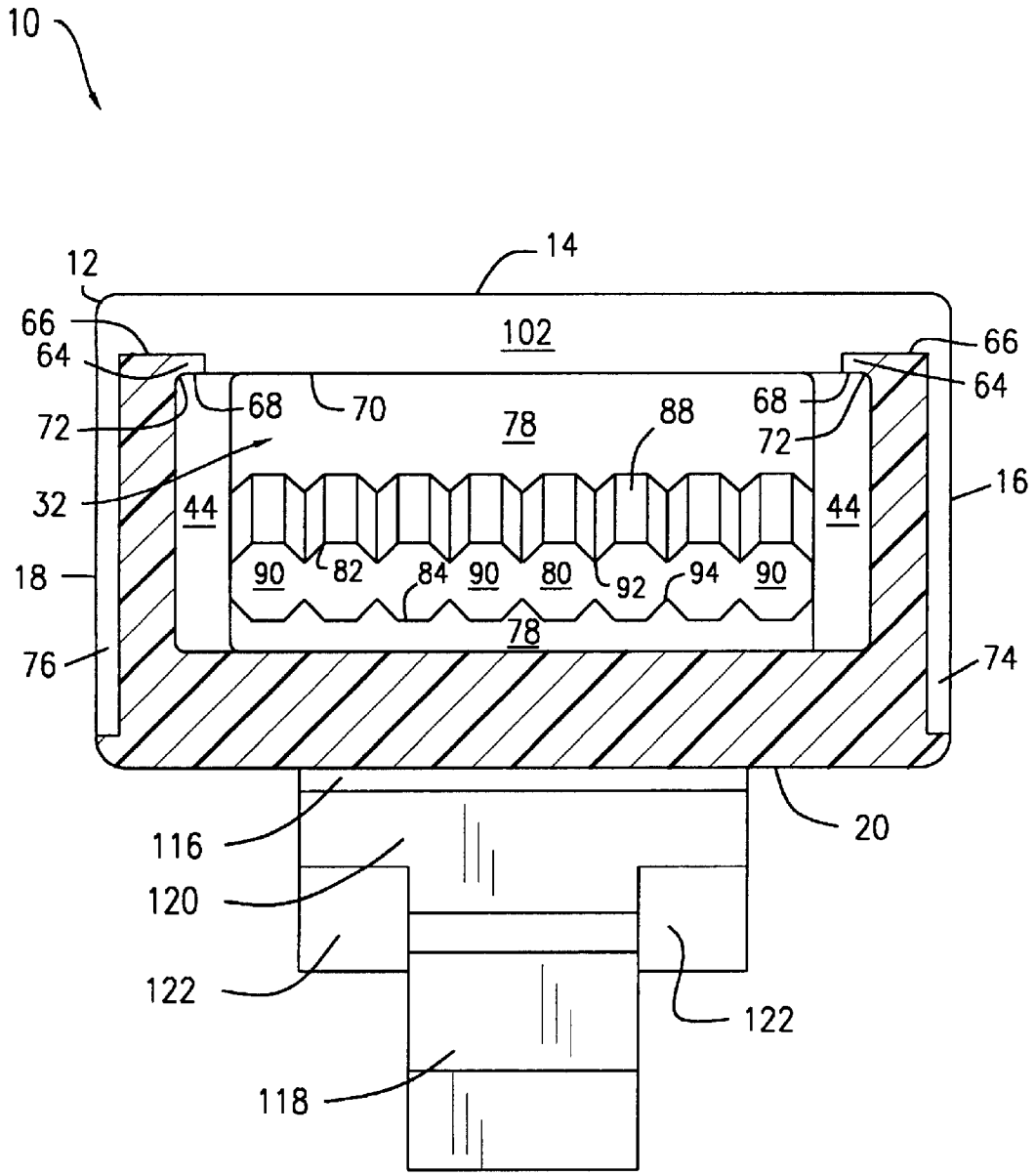
FIG. 9 is a cross-sectional view of the modular plug of FIG. 1 taken along line C—C of FIG. 5.

In addition to opening 62 and previously mentioned sloping guide walls 44, intermediate section 28 also includes other important features. As most clearly seen in FIGS. 8–9, but also visible in FIGS. 1–5, a pair of opposed longitudinal projections or lips 64 extend horizontally inwardly from the top 66 of sidewalls 16 and 18. The under-surface 68 of projections 64 is shown as coplanar with the interior ceiling surface 70, i.e., the interior top surface of the portion of cable receiving cavity 32 in intermediate section 28 (FIGS. 4, 8, and 9). As a modification to the foregoing, under-surface 68 may protrudes further interiorly of cable receiving cavity 32. The intersections of under-surfaces 68 with sidewalls 16 and 18 produce interior corners 72 (FIG. 9) which can extend a distance less than the length of the intermediate portion, or alternately, may extend a distance equal to the length of the intermediate portion. These interior corners 72 provide a means of limiting any pair of conductors 40 which is routed near a sidewall from lifting above top 14 of modular plug 10 during the assembly process of inserting a cable and conductors into the plug. The lift-limiting corners 72 will help prevent a conductor pair from rising above the exterior of the plug, where it might be subject to damage due to not being protected by the body 12 of plug 10. Projection 64 may be from one sidewall only, or may consist of multiple projections from the same sidewall (not shown). Projections 64 preferably extend inwardly from both sidewalls 16 and 18, provided that they do not close opening 62. Under-surfaces 68 are located substantially away from the conductor pairs and do not serve as guide surfaces or alignment guides for the insertion of the conductors into contact terminating section 30.

Figure 12:
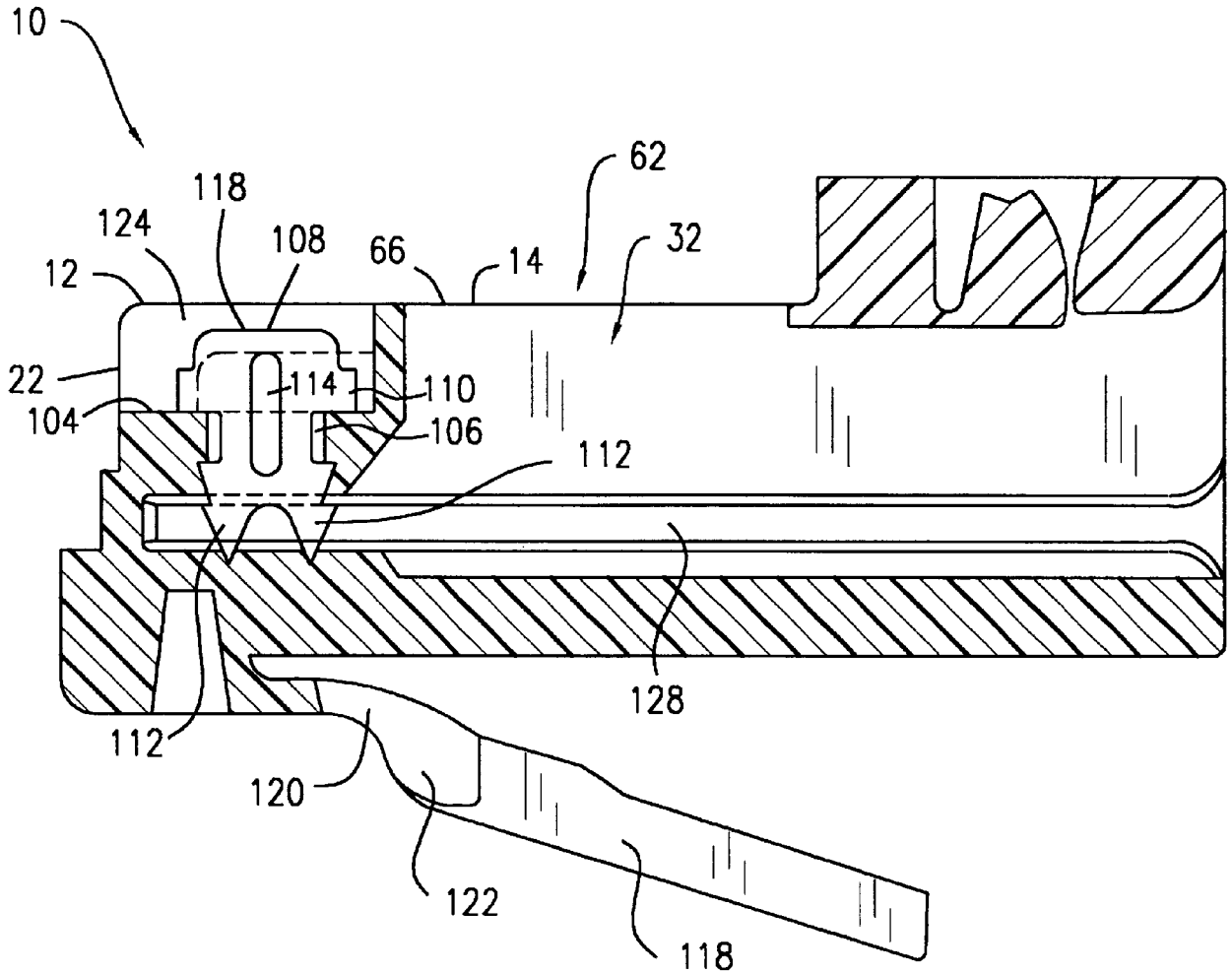
FIG. 12 is a longitudinal sectional view which illustrates a second preferred embodiment of a telephone-style modular plug of the present invention.

In a second preferred embodiment shown in FIG. 12, projections 64 are eliminated (cf. FIGS. 4 and 12), which expands opening 62 even further compared to the first embodiment of FIGS. 1–11. Both embodiments are within the present invention, since each has its own distinct advantages. The projections of the first embodiment protect the conductor pairs, as explained above. The expanded opening 62 of the second embodiment further reduces the composite dielectric constant which concomitantly reduces NEXT. Nonetheless, in either case, the dielectric effect produced by opening 62 contributes to a lower composite dielectric constant than prior art plugs for the intermediate portion 28 of plug 10, which produces significantly improved signal performance and lower crosstalk in the transition area of the conductors.

Another feature in intermediate section 28 is exterior notches 74 and 76 (FIGS. 3, 5, and 10) in sidewalls 16 and 18, respectively, which assist a handler in gripping modular plug 10.

Contact terminating section 30 is the free end which mates with a female, telephone-style modular jack (not shown). Conductors 40 are therefore arranged such that they will make electrical contact with the spring contacts of a standard modular jack in conformance with the architecture required by FCC regulations. Referring to the cross-sectional view in FIG. 4, contact terminating section 30 joins intermediate section 28 at wall 78. Opening into wall 78 is an elongated, conductor-positioning slot 80 bordered by an upper surface 82 and a lower surface 84. Upper slot surface 82 includes a horizontal portion 86 and an upwardly angled portion 88, whereas lower slot surface 84 is strictly horizontal. Also see FIGS. 3 and 7–9.

Angled portion 88 is steeper than corresponding angled surfaces of prior art plugs. The steeper slope of angled portion 88 allows conductors 40 to be untwisted for a shorter distance prior to insertion into slot 80, so that the twisted arrangement of each conductor pair is preserved for the maximum distance. This preservation of conductors 40 as twisted pairs to within a close proximity of the contact terminating section 30 provides more control of the electrical field surrounding each conductor up to the point of separation from the conductor pair. The benefit of this steeply angled surface is a further reduced crosstalk between the conductor pairs and the conductors belonging thereto.

A plurality of channels 90 are defined within slot 80 by opposed ridges 92 and 94. FIG. 4 shows a sectional side view of one of the channels 90, while FIGS. 8 and 9 show an end and cross-sectional view of wall 78 and slot 80 as seen through cable receiving cavity 32 from the direction of the rear 24. FIG. 10 shows a sectional view taken along lines D—D of FIG. 8 looking down on lower slot surface 84. Each channel 90 receives one conductor 40 and constrains it against movement toward or away from the other conductors 40.

As most clearly seen in FIGS. 4 and 10, channels 90 are closed at their front ends 96. Prior to cable 36 being inserted into modular plug 10, the terminal end 34 thereof is stripped of jacket 38 to expose the twisted pairs of conductors 40. Cable 36 is inserted into modular plug 10, the terminal end of each pair of conductors 40 is untwisted enough to fit within channel 90 with the tip of the conductor abutting end 96, and the terminal ends of the individual conductors are fully inserted into channels 90. This position is shown in FIG. 1. Cable 36 is then forced further into plug 10 to the position shown in FIG. 2. This last step gently crimps the twisted pairs which are exposed within intermediate section 28, making them bulge in different directions. The exposed twisted pairs are then non-parallel, i.e., they extend at different angles relative to the other pairs, and they are separated by larger distances than they were prior to their crimping. These conditions reduce NEXT in intermediate section 28. Being at different angles reduces the magnetic interactions, and being further apart reduces the capacitive effects. Since the bulging is largely uncontrollable, dependent on the relative resistances felt by the conductors, some arrangements of twisted pairs may not be as effective in reducing NEXT as others might be. Opening 62 in intermediate section 28 permits visual inspection of the twisted pairs and manual repositioning of them, if desired. This is the fourth way of reducing NEXT in intermediate section 28, mentioned initially hereinabove.

Figure 3:
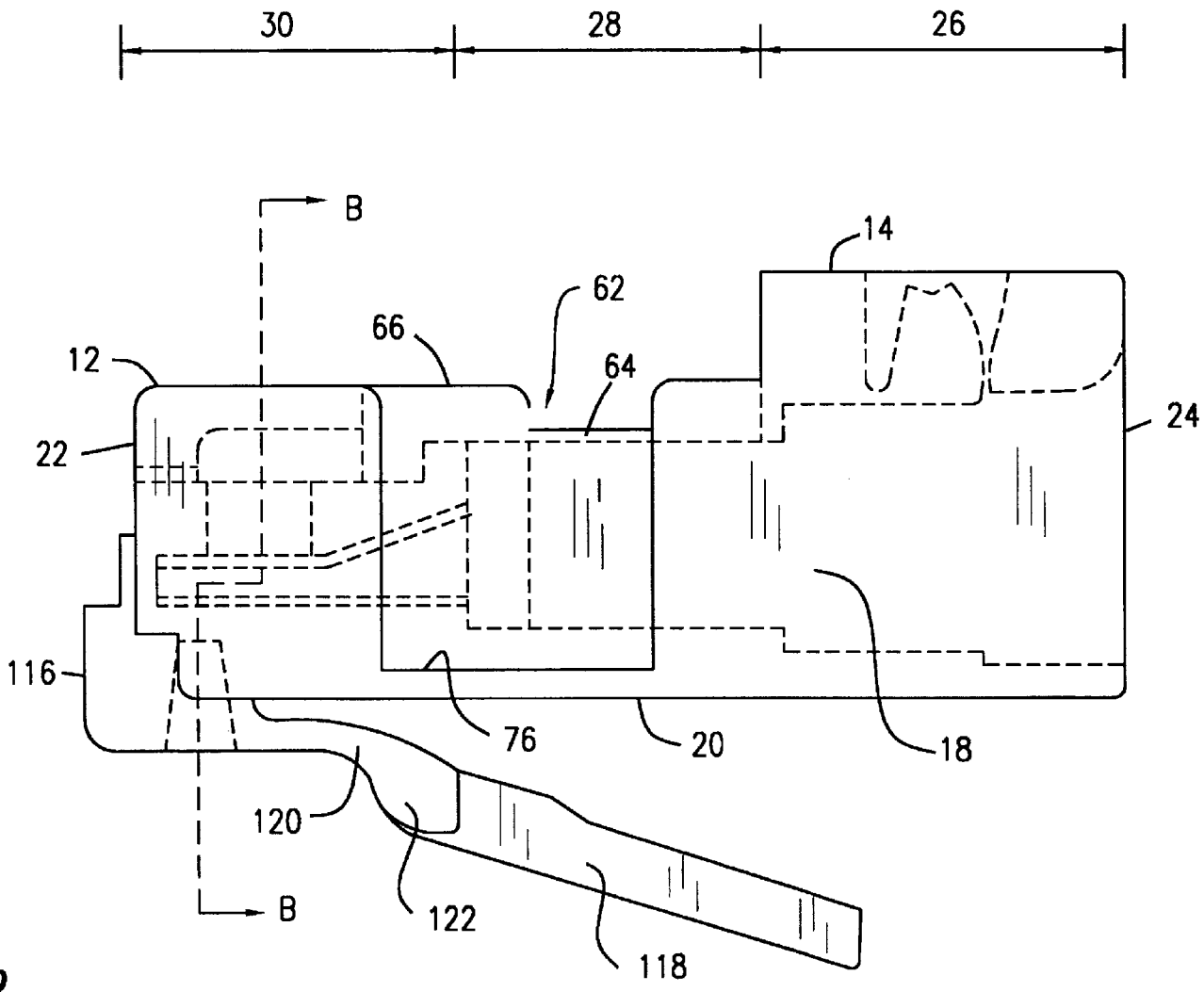
FIG. 3 is a side view of the modular plug of FIG. 1.
Figure 4:
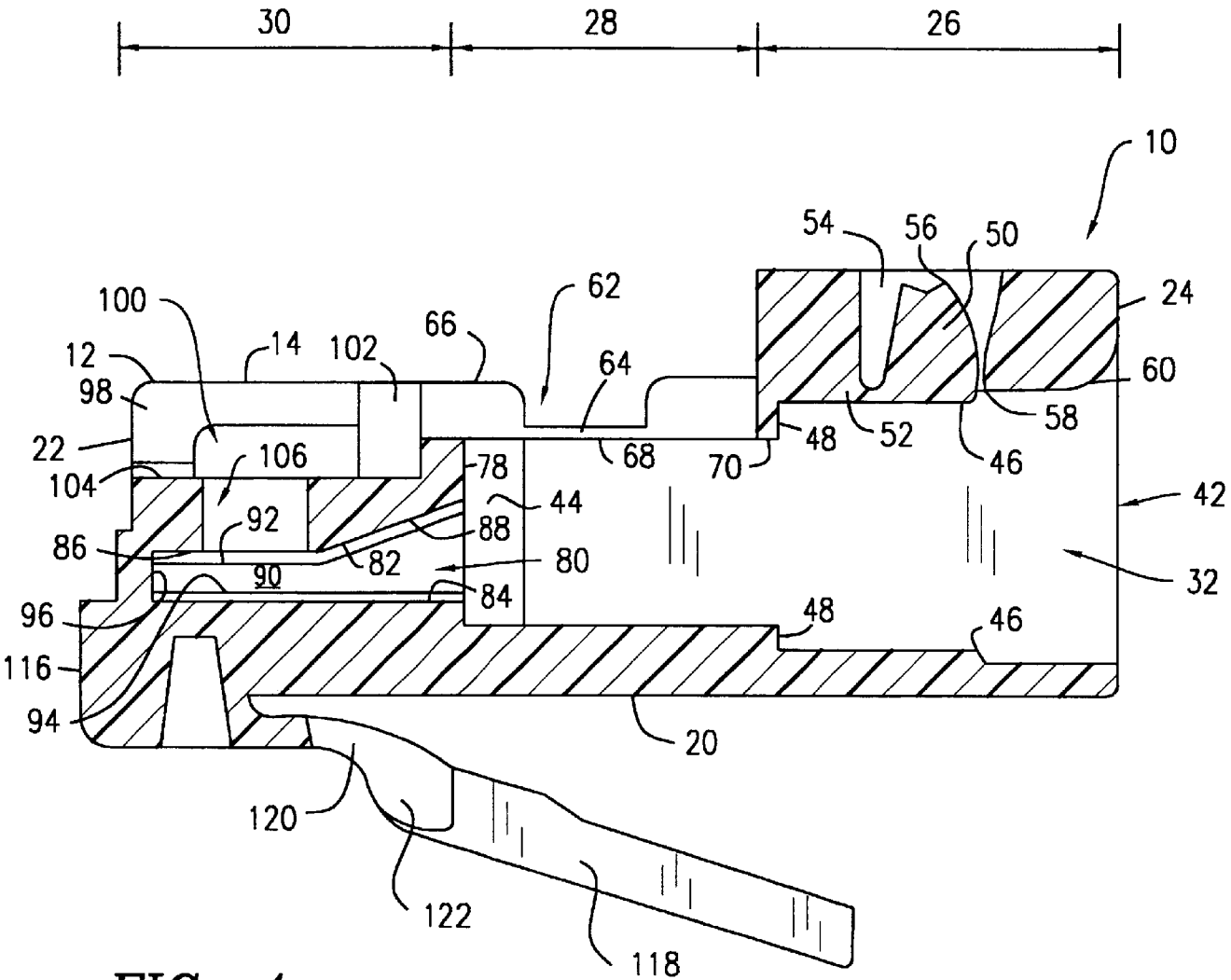
FIG. 4 is a longitudinal sectional view of the modular plug of FIG. 1 taken along line A—A of FIG. 5.
Figure 6:
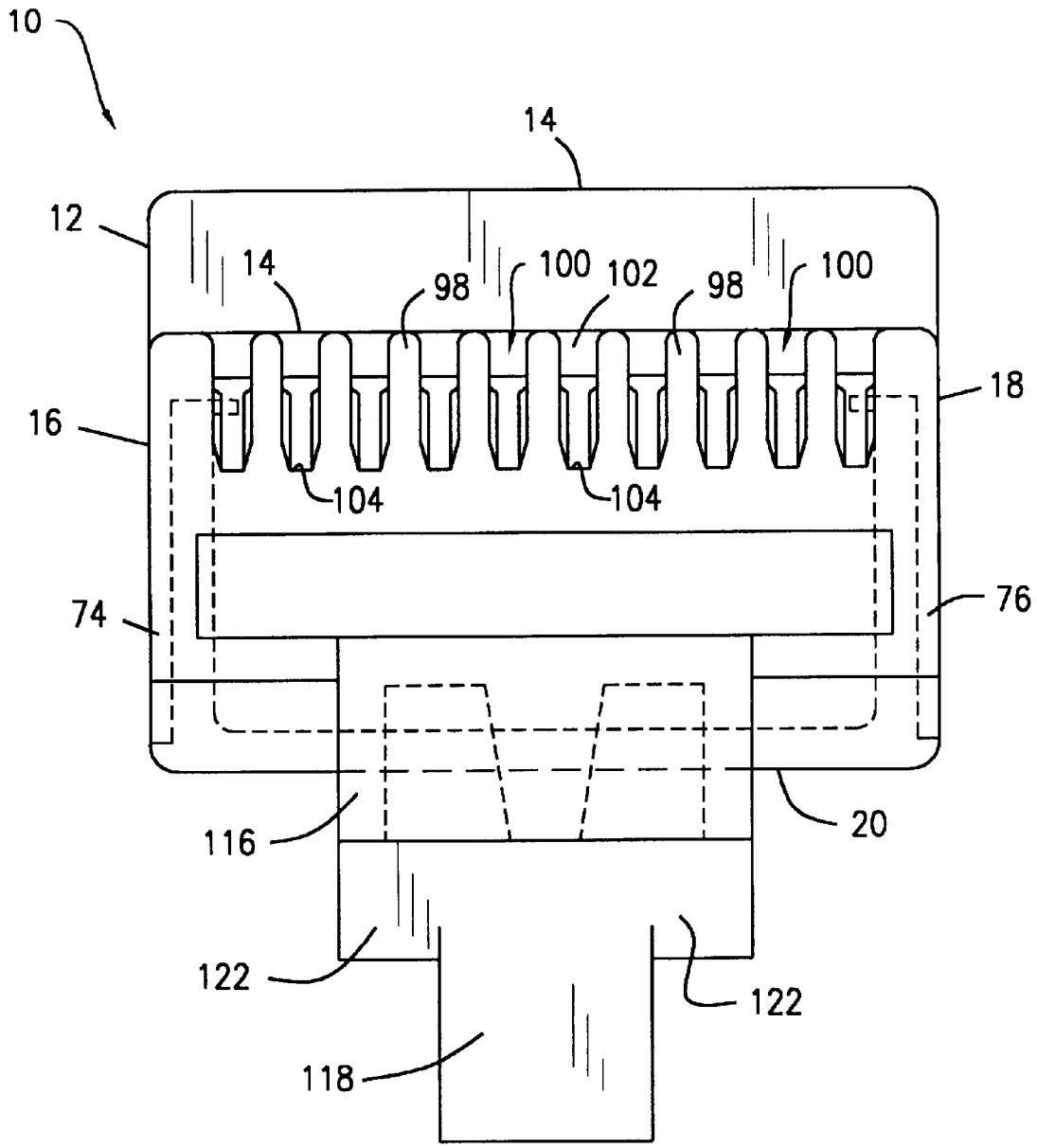
FIG. 6 is a front view of the modular plug of FIG. 1.
Figure 7:
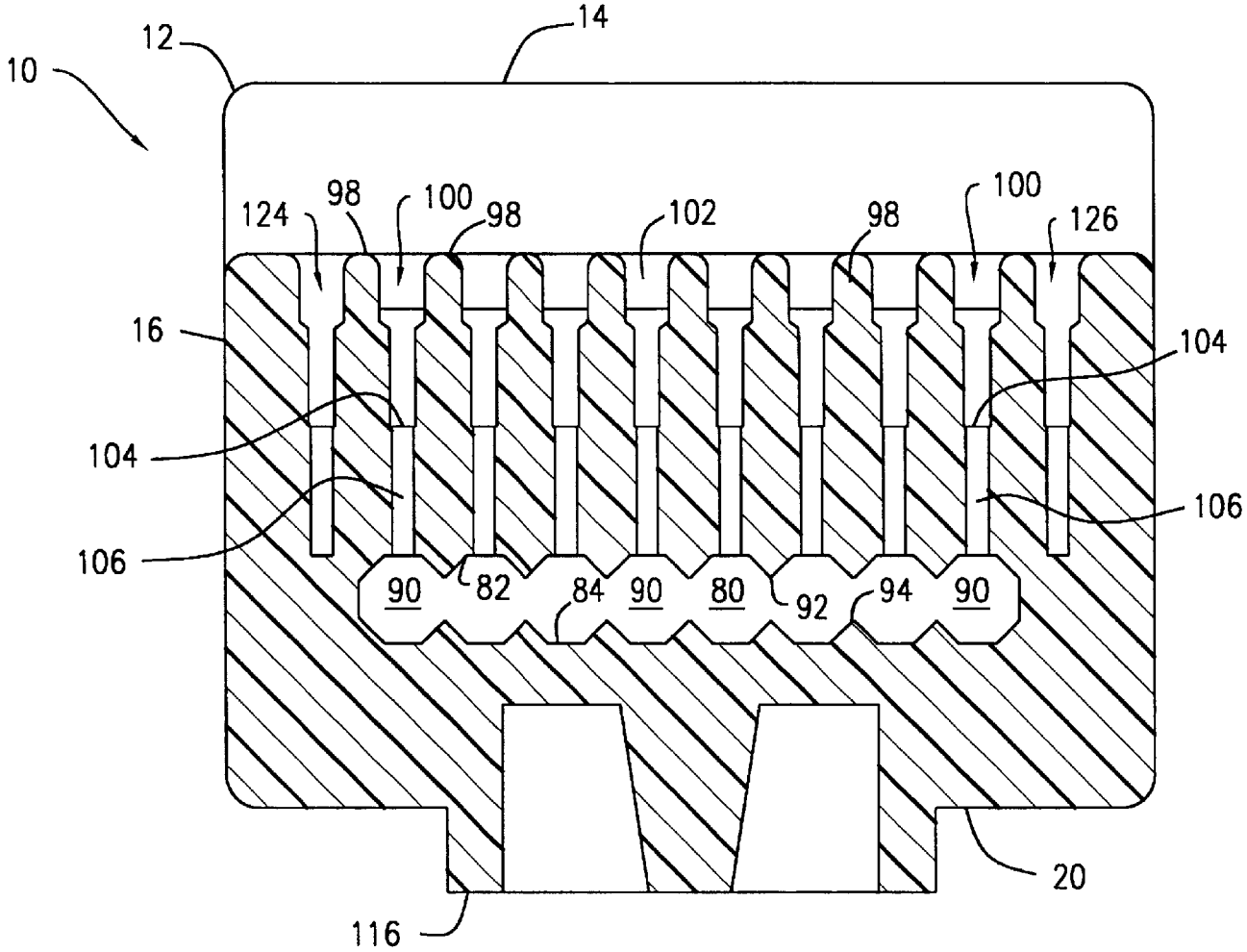
FIG. 7 is a cross-sectional view of the modular plug of FIG. 1 taken along line B—B of FIG. 3.

Referring now to FIGS. 6 and 7, a front view and a cross-sectional front view along the lines B—B of FIG. 3 are shown. A plurality of parallel, longitudinally extending partitions 98 are uniformly spaced across the width of modular plug 10. Terminal contact receiving slots 100 are formed between adjacent partitions 98 (only a few partitions and slots are referenced with numerals in the drawings to avoid overcrowding).

Figure 5:
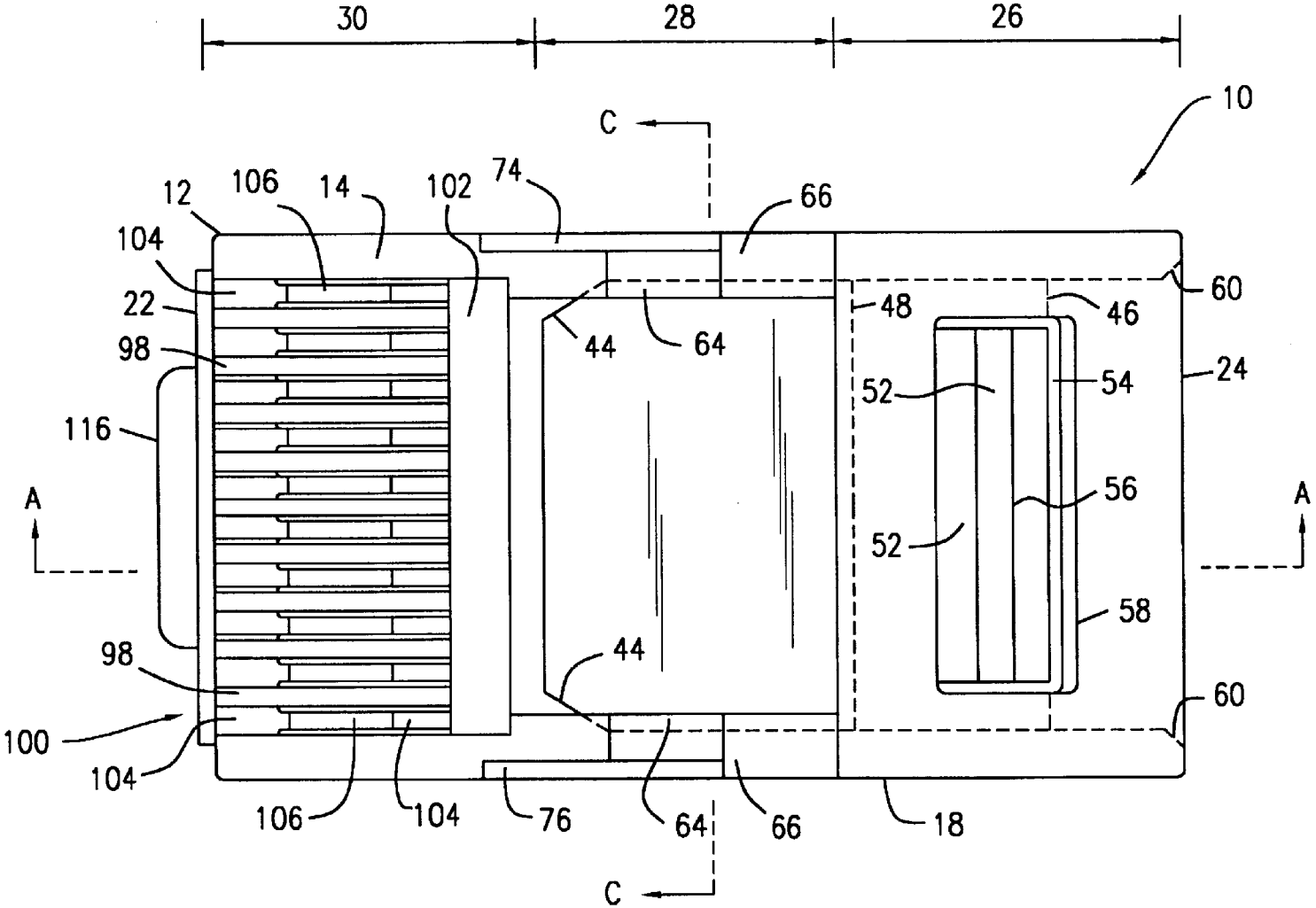
FIG. 5 is a top view of the modular plug of FIG. 1.

FIG. 4 shows a sectional view of a slot 100 taken along line A—A of FIG. 5. Each slot 100 extends from front 22 of plug 10 to a raised transverse partition 102 (FIGS. 4–5), is open through top 14, and has a bottom ledge 104 opposite top 14. Bottom ledge 104 includes a narrow rectangular opening 106 which communicates with both slot 100 and the underlying channel 90. A terminal contact 108 (FIGS. 1–2 and 11–13) is forced into each slot 100 until shoulders 110 of contact 100 rest on ledge 104. Tangs 112 of contact 108 pass through opening 106 into channel 90, where they pierce the insulation surrounding the conductor 40 residing in channel 90 (not shown). Terminal contact 108 includes a rounded cap 113 designed to make electrical contact with the spring contacts of the mating modular jack, and, as disclosed and claimed by Kristiansen, supra, terminal contact 108 further includes an elongated aperture 114 through contact 108 which reduces the capacitance between adjacent contacts.

Centered on front 22 and protruding therefrom is a conventional guide nose 116 for keying the fit with the mating modular jack. A conventional locking tab 118 is pivotally mounted to bottom 20 at 120 and extends obliquely rearwardly therefrom. Locking tab 118 includes spaced shoulders 122 for locking with complementary latching members (not shown) on the mating modular jack.

Referring now to FIGS. 7 and 11–13, there are times when modular plug 10 is required to carry additional lines of information. In a modification of the first preferred embodiment, plug 10 is adapted to carry ten conductors, be they in the form of a ten conductor cable or the addition of two single conductors. Flanking the eight channels 90 (FIG. 7) are two additional slots 124 and 126 which add plug positions 0 and 9 to the regularly provided eight positions 1–8. Slots 124 and 126 communicate via additional rectangular openings 106 (not shown) with two additional conductor holding channels 128 recessed in sidewalls 16 and 18 (only one being shown in FIGS. 11–13). The FIG. 11 embodiment is identical to the first preferred embodiment shown in FIGS. 1–10 except for the addition of channels 128, which expand the utility of modular plug 10.

FIG. 12 adds to the first preferred embodiment both the additional channels 128 and the elimination of projections 64, as aforedescribed.

Figure 13:
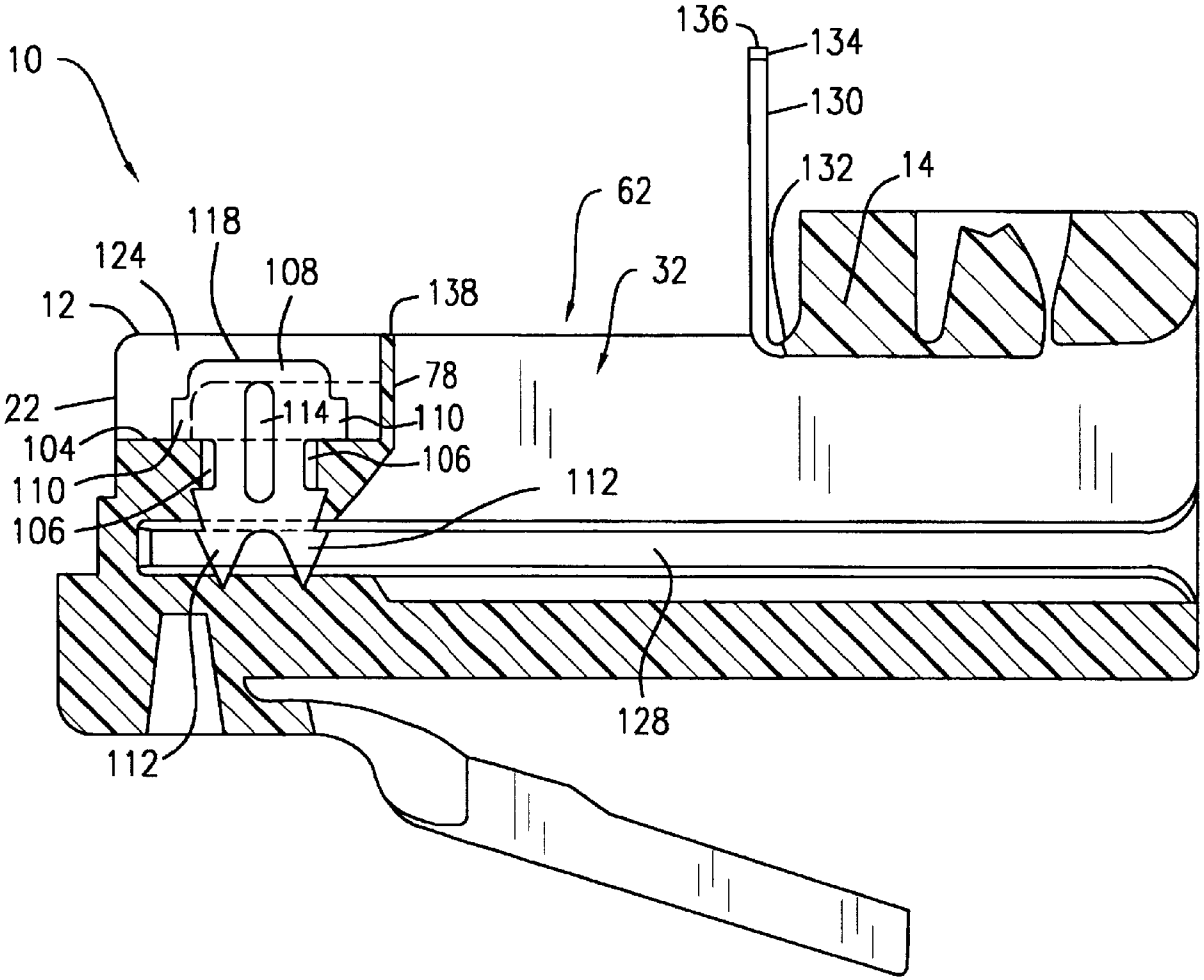
FIG. 13 is a longitudinal sectional view which illustrates a third preferred embodiment of a telephone-style modular plug of the present.

FIG. 13 is also identical to the first preferred embodiment except that to this embodiment has been added a protective grating bar 130 hinged at 132 to top 14. As few as one grating bar 130 can be employed, or as many as needed, to prevent conductors 40 from extending above top 14. Plural grating bars 130 can be provided with a common pivot 132 for all grating bars or with each having its own pivoting area such that each grating bar can be pivoted independently of the others. The length of each grating bar 130 is approximately that of the length of opening 62 such that the free end 134 will engage wall 78 after being pivoted to a horizontal orientation from its original vertical orientation. Hinge 132 consists of a thin wall of material such that grating bar 130 may be rotated ninety degrees from its original orientation and hinge 132 will flex and stretch to a new shape without losing strength or fracturing in the pivoting area. Grating bars 130 can include one or more extension tips 136 which are of a size that they will engage corresponding slots 138 in wall 78.

It can be seen from the above that an invention has been disclosed which fulfills all the objects of the invention. It is to be understood, however, that the disclosure is by way of illustration only and that the scope of the invention is to be limited solely by the following claims.

I claim as my invention:

1. A modular telephone-style male plug, comprising:

a contact mating portion, comprised of a first set of four sides, which includes a plurality of contact slots each for receiving a contact blade;

a plurality of contact blades, each said contact blade with an upper mating surface for mateable engagement with a spring contact portion of a modular female jack or outlet, each said contact blade comprising a conductor engaging tip opposite said upper mating surface to electrically terminate and connect to a conductor of a plurality of conductors, each said conductor comprising an electrically conductive wire surrounded by an insulating cover;

a plurality of channels, each said channel having a length and a height to receive said conductor such that a portion of each said channel is located adjacent and in alignment with one said contact slot, said length of each said channel being greater than said height of each said channel, whereby each said contact slot aligns each said contact blade to electrically connect to each said conductor;

a cable receiving portion comprised of a second set of four sides and including a cable capture mechanism to engage a cable find retain said cable within said cable receiving portion, an opening formed in the interior of said cable receiving portion for receiving said cable, said cable comprising one or more pairs of solid plurality of conductors;

an intermediate portion comprising one latch wall having an interior floor and two side walls, said latch wall and said side walls forming an interior space therebetween, said interior space able to contain said one or more pairs of said conductors which traverse said modular plug from said cable receiving portion to said contact mating portion;

said intermediate portion further comprising at least one opening, said opening opposite said interior floor of said latch wall, said opening being in direct communication with space surrounding said plug and in direct communication with said interior space of said intermediate portion of said plug; and at least one projecting surface extending from at least one of said side walls such that said projecting surface overhangs a portion of said interior floor, said projecting surface forming an interior corner at the intersection of said projecting surface with said side wall, the outer surface of said projecting surface not extending above the top wall of said plug.

2. A modular plug as set forth in claim 1, in which said opening has the same width as the width between said two side walls.

3. A modular plug as set forth in claim 2, in which the length of said opening is substantially the same as the length of said interior floor of said intermediate portion of said plug.

4. A modular plug as set forth in claim 3, further comprising a slanted surface located at the junction of said intermediate portion and said contact mating portion, said slanted surface being in direct communication with said opening of said plug.

5. A modular plug as set forth in claim 1, in which said projecting surface extends a first distance from said side wall, said first distance being at least as great as the diameter of said conductor.

6. A modular plug as set forth in claim 1, in which said projecting surface extends a second distance from said side wall, said second distance being at least as great as the diameter of said conductor pair.

7. A modular plug as set forth in claim 1, further comprising at least two projecting surfaces extending from a respective one of said side walls, each of said surfaces integrally joined to said side wall and overhanging a portion of said interior floor, respectively.

8. A modular plug as set forth in claim 7, wherein said projecting surfaces are not directly connected to each other.

9. A modular telephone-style male plug, comprising:

a contact mating portion, comprised of a first set of four sides, which includes a plurality of contact slots each for receiving a contact blade;

a plurality of contact blades, each said contact blade with an upper mating surface for mateable engagement with a spring contact portion of a modular female jack or outlet, each said contact blade comprising a conductor engaging tip opposite said upper mating surface to electrically terminate and connect to a conductor of a plurality of conductors, each said conductor comprising an electrically conductive wire surrounded by an insulating cover;

a plurality of channels, each said channel having a length and a height to receive said conductor such that a portion of each said channel is located adjacent and in alignment with one said contact slot, said length of each said channel being greater than said height of each said channel, whereby each said contract slot aligns each said contact blade to electrically collect to each said conductor;

a cable receiving portion comprised of a second set of four sides and including a cable capture mechanism to engage a cable and retain said cable within said cable receiving portion, an opening formed in the interior of said cable receiving portion for receiving said cable, said cable comprising one or more pairs of said plurality conductors;

an intermediate portion comprising one latch wall having an interior floor having a length and a width and two side walls, said latch wall and said side walls having an interior space therebetween, said interior space able to contain said one or more pairs of said conductors which traverse said modular plug from said cable receiving portion to said contact mating portion;

said intermediate portion further comprising at least one opening, said opening opposite said interior floor of said latch wall, said opening being in direct communication with space surrounding said plug and in direct communication with said interior space of said intermediate portion of said plug; and at least one substantially planar surface, said planar surface having one free end and being oriented substantially perpendicularly to said mating wall of said plug, such that said planar surface is integrally connected to said plug at one end by means of a pivotable connection such that said planar surface can be rotated about said pivotable connection from a substantially perpendicular orientation to a substantially parallel orientation to said mating wall of said plug.

10. A modular plug as set forth in claim 9, in which said planar surface has a length substantially equal to said length of said interior floor of said intermediate portion.

11. A modular plug as set forth in claim 10, in which said free end further comprises at least one projection which extends beyond said free end of said planar surface, said projection being of such a size and shape to engage a corresponding slot formed at the junction of said intermediate portion and said contact mating portion.

12. A modular plug as set forth in claim 11 further comprising a slanted surface located at the junction of said intermediate portion and said contact mating portion of said plug, and such that said slanted surface is in direct communication with said opening of said plug.

13. A modular plug as set forth in claim 12, in which said slanted surface has an upper edge with means for engaging said planar surface upon rotation of planar surface from said vertical orientation to said horizontal orientation.

14. A modular plug as set forth in claim 13, in which said upper edge engaging means comprising at least one slot extending from outer surface of upper edge into said upper edge.

15. The combination of a modular plug and a data transmission cable, comprising:

a cable comprising a jacket and a plurality of twisted pairs of conductors within said jacket, said twisted pairs of conductors having contact ends, said cable further including a cable terminal end through which said contact ends of said plurality of twisted pairs of conductors are exposed; and a modular plug comprising:

a cable receiving section, an intermediate section, and a contact terminating section;

said cable receiving section comprising a cavity with said cable received therein;

said intermediate section having two side walls closed by a bottom wall with an opening opposed to said bottom wall by a pair of inwardly facing projections, said intermediate section containing said exposed contact ends of said conductors; and said contact terminating section comprising a plurality of conductor receiving channels, each of which receive therein a single one of said conductor contact ends and a contact terminal electrically connected with said single conductor contact end, said contact terminal being arranged to mate with the spring contacts of a female modular jack.

16. The combination of claim 15, wherein said cable receiving section includes a strain relief mechanism for constraining said cable against relative movements.

17. The combination of claim 15, wherein said opening extends from said cable receiving section to said contact terminating section and from one side wall to the other side wall.

18. The combination of claim 17, wherein said side walls and said bottom define an interior space and at least one grating bar extends over said opening to prevent said exposed conductors from protruding outside said interior space.

19. The combination of claim 18, wherein said grating bar is pivotally mounted adjacent said opening.

20. A modular telephone-style male plug, comprising;

a contact mating portion, comprised of a first set of four sides, which includes a plurality of contact slots, each for receiving a contact blade;

a plurality of contact blades, each said contact blade with an upper mating surface for mateable engagement with a spring contact portion of a modular female jack or outlet, each said contact blade comprising a conductor engaging tip opposite said upper mating surface to electrically terminate and connect to a conductor of a plurality of conductors, each said conductor comprising an electrically conductive wire surrounded by an insulating cover;

a plurality of channels, each said channel having a length and a height to receive said conductor such that a portion of each said channel is located adjacent and in alignment with one said contact slot, said length of each said channel being greater than said height of said channel, whereby said contact slot aligns each said contact blade to electrically connect to said plurality of conductors;

a cable receiving portion comprised of a second set of four sides and including a cable capture mechanism to engage a cable and retain said cable within said cable receiving portion, an opening formed in the interior of said cable receiving portion for receiving said cable, said cable comprising one or more pairs of said conductors;

an intermediate portion comprising one latch wall having an interior floor and two side walls, said latch wall and said side wall latching an interior space therebetween, said interior space able to contain said one or more pairs of said conductors which traverse said modular plug from said cable receiving portion to said contact mating portion;

said intermediate portion further comprising at least one opening, said opening opposite said interior floor of said latch wall, said opening being in direct communication with space surrounding said plug and in direct communication with said interior space of said intermediate portion of said plug; and at least two projecting surfaces extending from a respective one of said side walls, each of said surfaces integrally joined to said side wall and overhanging a portion of said interior floor, respectively.

21. A modular plug as set forth in claim 20, wherein said projecting surfaces are not directly connected to each other.

22. The combination of a modular plug and a data transmission cable, comprising:

a cable comprising a jacket and a plurality of twisted pairs of conductors within said jacket, said twisted pairs of conductors having contact ends, said cable further including a cable terminal end through which said contact ends of said plurality of twisted pairs of conductors are exposed; and a modular plug comprising:

a cable receiving section, an intermediate section, and a contact terminating section;

said cable receiving section comprising a cavity with said cable received therein;

said intermediate section including two side walls and a bottom wall and an opening opposed to said bottom wall with a grating bar pivotally over said opening, said intermediate section containing said exposed contact ends of said conductors; and said contact terminating section comprising a plurality of conductor receiving channels, each of which receive therein a single one of said conductor contact ends and a contact terminal electrically connected with said single conductor contact end, said contact terminal being arranged to mate with the spring contacts of a female modular jack.

23. The combination of claim 22, wherein said grating bar is pivotally mounted adjacent said opening.

* * * * *